US006086066A

United States Patent [19]

Takeuchi et al.

[11] Patent Number: 6,086,066

[45] Date of Patent: Jul. 11, 2000

[54] REEL APPARATUS FOR GAME MACHINE

[75] Inventors: Susumu Takeuchi; Yukihiro Yuasa, both of Minato-ku, Japan

[73] Assignee: Aruze Corporation, Tokyo, Japan

[21] Appl. No.: 09/076,715

[22] Filed: May 13, 1998

[30] Foreign Application Priority Data

Jun. 23, 1997 [JP] Japan ..... 9-181805

[51] Int. Cl.[7] ..... G07F 17/34

[52] U.S. Cl. ..... 273/143 R; 273/138.2; 463/20

[58] Field of Search ..... 273/143 R, 138.2; 463/20

[56] References Cited

U.S. PATENT DOCUMENTS

| | | | |
|---|---|---|---|
| 5,152,529 | 10/1992 | Okada | 273/143 R |
| 5,395,111 | 3/1995 | Inoue | 273/143 R |
| 5,449,173 | 9/1995 | Thomas . | |
| 5,752,881 | 5/1998 | Inoue | 273/143 R |

FOREIGN PATENT DOCUMENTS

| | | | |
|---|---|---|---|
| 0484103 A2 | 5/1992 | European Pat. Off. | G07F 17/34 |
| 2921159 A1 | 12/1980 | Germany | G07F 17/34 |
| 3105266 A1 | 9/1982 | Germany | G07F 17/34 |

*Primary Examiner*—Benjamin H. Layno

*Attorney, Agent, or Firm*—Snider & Chao LLP; Ronald R. Snider

[57] ABSTRACT

Disposed in front of the lastly stopping center reel 12B of three reels 12A, 12B, and 12C is a cover member 16 which is movable between the position of a display apparatus 108*a* and a shelter position thereabove and is formed with a picture Fo. When the reel 12B is stopped with its picture Fo placed at the display window 108*a*, in the case where each of the other two reels 12A and 12C is stopped with the picture Fo placed at the display window 108*a* (in the case of a jackpot), the cover member 16 is moved from the shelter position to the position of the display window 108*a* and minutely vibrates at the position of the display window 108*a* before being stopped, whereby the picture Fo' formed in the cover member 16 appears in an unusual mode. Accordingly, the player's impression when winning a jackpot in a game machine equipped with thus configured reel apparatus can be fully enhanced, thus allowing enjoyability thereof to improve.

5 Claims, 4 Drawing Sheets

REEL APPARATUS FOR GAME MACHINE

RELATED APPLICATIONS

This application claims the priority of Japanese Patent Application No. 9-181805 filed on Jun. 23, 1997, which is incorporated herein by reference.

BACKGROUND OF THE INVENTION

1. Field of the Invention

The present invention relates to a reel apparatus installed in a game machine such as a slot machine. The present invention can widely be used for improving enjoyability of various kinds of amusement machines.

2. Description of the Prior Art

In a slot machine (reel rotation automatic stop type), a slot section of a pachinko (Japanese upright pinball) machine, or the like, there is provided a reel apparatus which has a plurality of reels and automatically stops rotation of each reel after a predetermined lapse of time from the start of rotation. In general, this reel apparatus has the following configuration.

Namely, the plurality of reels are adapted to rotate independently from each other around a single axis, whereas a plurality of pictures are formed in series on the peripheral surface of each reel along its circumferential direction. Upon a starting operation by a player or the like, these reels simultaneously start rotating. Thereafter, the reels automatically stop in sequence, each placing one of the plurality of pictures at a display window in front of the reel.

In such a so-called automatic stop type reel apparatus, however, a prize would be won only when a combination of pictures appearing in the display windows in front of the reels coincides with a specific picture pattern. Accordingly, the player winning a prize may not always be impressed sufficiently, thus lacking enjoyability.

SUMMARY OF THE INVENTION

In view of such circumstances, it is an object of the present invention to provide a reel apparatus for a game machine, which can sufficiently enhance the player's impression when winning a prize, thereby enhancing enjoyability.

In the reel apparatus for a game machine in accordance with the present invention, in order to enhance the impression of winning a prize, a cover member formed with a predetermined picture is turned up in an unusual mode when the lastly stopping reel is stopped so as to yield a prize winning state, thereby achieving the above-mentioned object.

Namely, the present invention provides a reel apparatus for a game machine, comprising a plurality of reels which rotate around a single axis, each having a plurality of pictures formed in series on a peripheral surface thereof along a circumferential direction thereof, the reels being rotated independently from each other and automatically stopped in sequence while each placing one of the plurality of pictures at a preset angle position;

wherein a cover member formed with a predetermined picture and movable between the preset angle position and a shelter position other than the preset angle position is disposed in front of a lastly stopping reel of the plurality of reels; and wherein, when the lastly stopping reel is stopped so as to place a predetermined picture at the preset angle position, in the case where another reel is stopped so that a specific picture is placed at the preset angle position in combination with the predetermined picture, the cover member moves from the shelter position to the preset angle position and minutely vibrates at the preset angle position before being stopped.

The "predetermined picture" formed in the cover member may be the same as or different from the "predetermined picture" formed in each of the reels.

As long as the "cover member" is movable between the preset angle position and the shelter position, its mode of movement is not restricted in particular, i.e., it may be either linear movement or pivotal movement.

DESCRIPTION OF THE PREFERRED EMBODIMENTS

In the following, embodiments of the present invention will be explained with reference to the accompanying drawings. To begin with, a first embodiment of the present invention will be explained.

Figure 1:
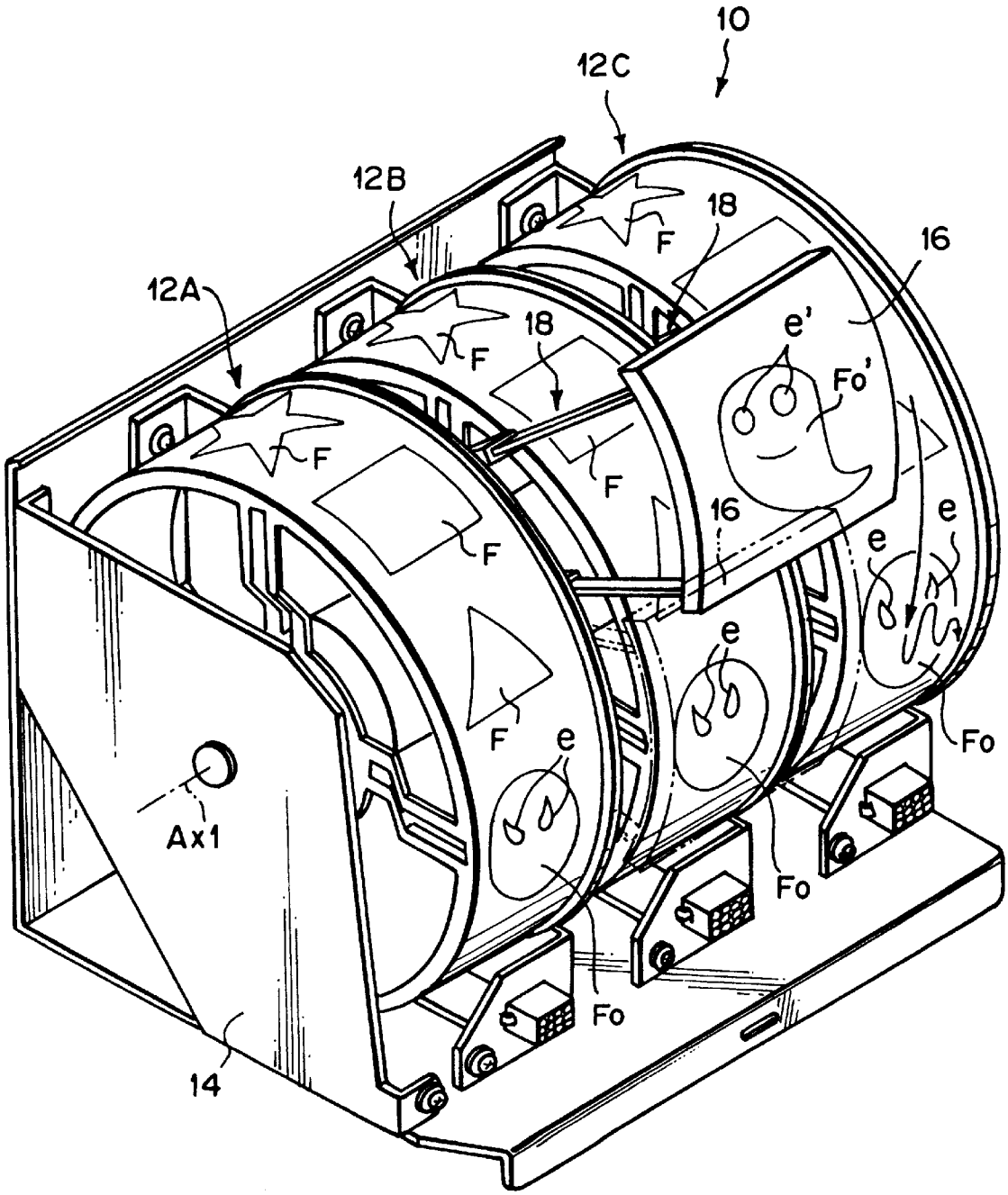
FIG. 1 is a perspective view showing a reel apparatus for a game machine in accordance with a first embodiment of the present invention.
Figure 2:
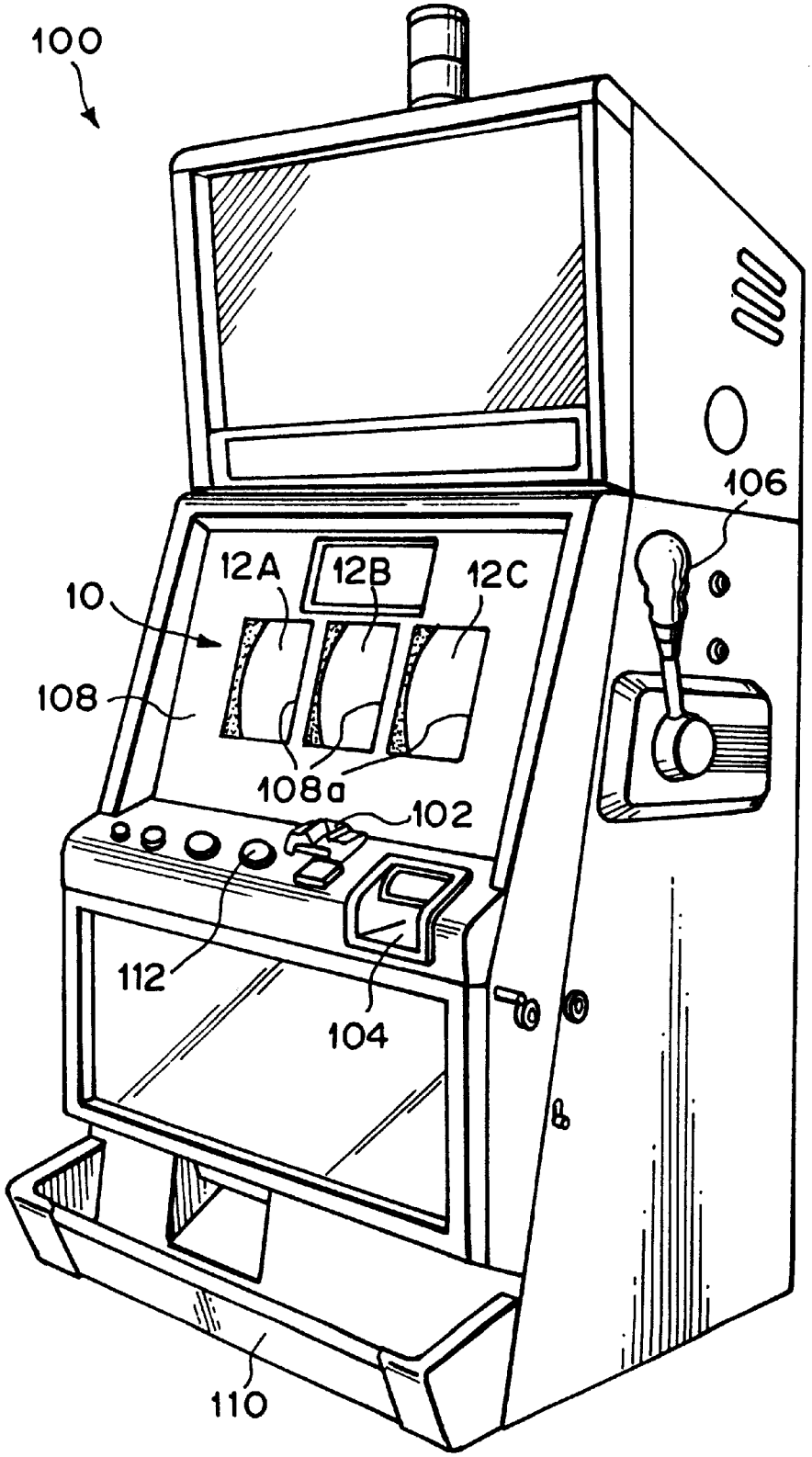
FIG. 2 is a perspective view showing a slot machine (game machine) in which the above-mentioned reel apparatus is incorporated.

FIG. 1 is a perspective view showing a reel apparatus of a game machine in accordance with this embodiment; whereas FIG. 2 is a perspective view showing a slot machine (game machine) in which this reel apparatus is incorporated.

As shown in FIG. 1, this reel apparatus 10 comprises three reels 12A, 12B, and 12C. The three reels 12A, 12B, and 12C are supported by a reel supporting bracket 14 so as to be rotatable independently from each other. Their axis of rotation Ax1 is set on a single axis. On the peripheral surface of each of the reels 12A, 12B, and 12C, a plurality of pictures F are formed in series along its circumferential direction.

As shown in FIG. 2, the above-mentioned slot machine 100 is a reel automatic stop type slot machine. When a handle lever 106 is pushed down on the front side (or a spin button 112 is pushed) while cash is inserted in a coin entry 102 or a bill entry 104, the reel apparatus 10 is actuated, so that the three reels 12A, 12B, and 12C start rotating at the same time. Thereafter, the left-side reel 12A, the right-side reel 12C, and the center reel 12B, in this order, automatically stop rotating.

Here, the reels 12A, 12B, and 12C stop rotating while each of which places one of the plurality of pictures F at its corresponding one of three display windows 108*a* formed in a reel glass plate 108.

In the case where the combination of pictures F shown in the three display windows 108*a* when the reels 12A, 12B, and 12C are stopped coincides with a predetermined prize winning pattern, the number of coins corresponding to the prize winning pattern flows out into a coin tray 110.

In each of the reels 12A, 12B, and 12C, the part formed with each picture F is constituted by a semitransparent member having a diffuse transmission characteristic. The picture F positioned at the display window 108*a* is brightly illuminated from its rear side with an illuminating means (not depicted) disposed within a space on the inner periphery side of each of the reels 12A, 12B, and 12C. Among the plurality of pictures F, the one indicated by Fo has a pair of slanted eyes e, each of which is constituted by a transparent member having a straight transmission characteristic (or through-hole).

In the case where the reels 12A, 12B, and 12C are stopped so that the picture Fo is shown in each of the three display windows 108*a* (in the state shown in FIG. 1), as a jackpot winning pattern, a large amount of coins flow out into the coin tray 110.

A player winning such a jackpot is impressed thereby. Here, it is preferable to produce a certain effect for enhancing the player's impression, in addition to simply causing a larger amount of coins to flow out into the coin tray 110.

From such a viewpoint, this embodiment is provided with a jackpot effecting structure as follows.

The instant at which the player gets an impression of a jackpot is when, of the three reels 12A, 12B, and 12C, the lastly stopping center reel 12B is stopped such that its picture Fo is placed at the display window 108*a*. Therefore, in this embodiment, at this instant, a hobgoblin picture Fo' shown in FIG. 1 appears in the display window 108*a* in front of the center reel 12B from thereabove, and is minutely vibrated before being stopped.

The picture Fo' is formed in the cover member 16. In the cover member 16, the part corresponding to the picture Fo' is constituted by a semitransparent member having a diffuse transmission characteristic, whereas the part corresponding to each of a pair of round eyes e' in this picture Fo' is constituted by a transparent member having a straight transmission characteristic (or through-hole). The pair of eyes e' are formed with the same lateral pitches as those of the pair of eyes e in the picture Fo of the reel 12B, so as to be positioned at substantially the same level as the pair of eyes e when the picture Fo' is stopped at the display window 108*a*.

The cover member 16 is constituted by a substantially rectangular plate-like member having an arc-shaped side cross section, and is configured such that it can be placed, in front of the center reel 12B, at the position of the display window 108*a* (preset angle position) and a shelter position thereabove. In order to realize this configuration, the cover member 16 is secured to a tip portion of each of a pair of pivotal levers 18 on the right and left end sides thereof.

Figure 3:
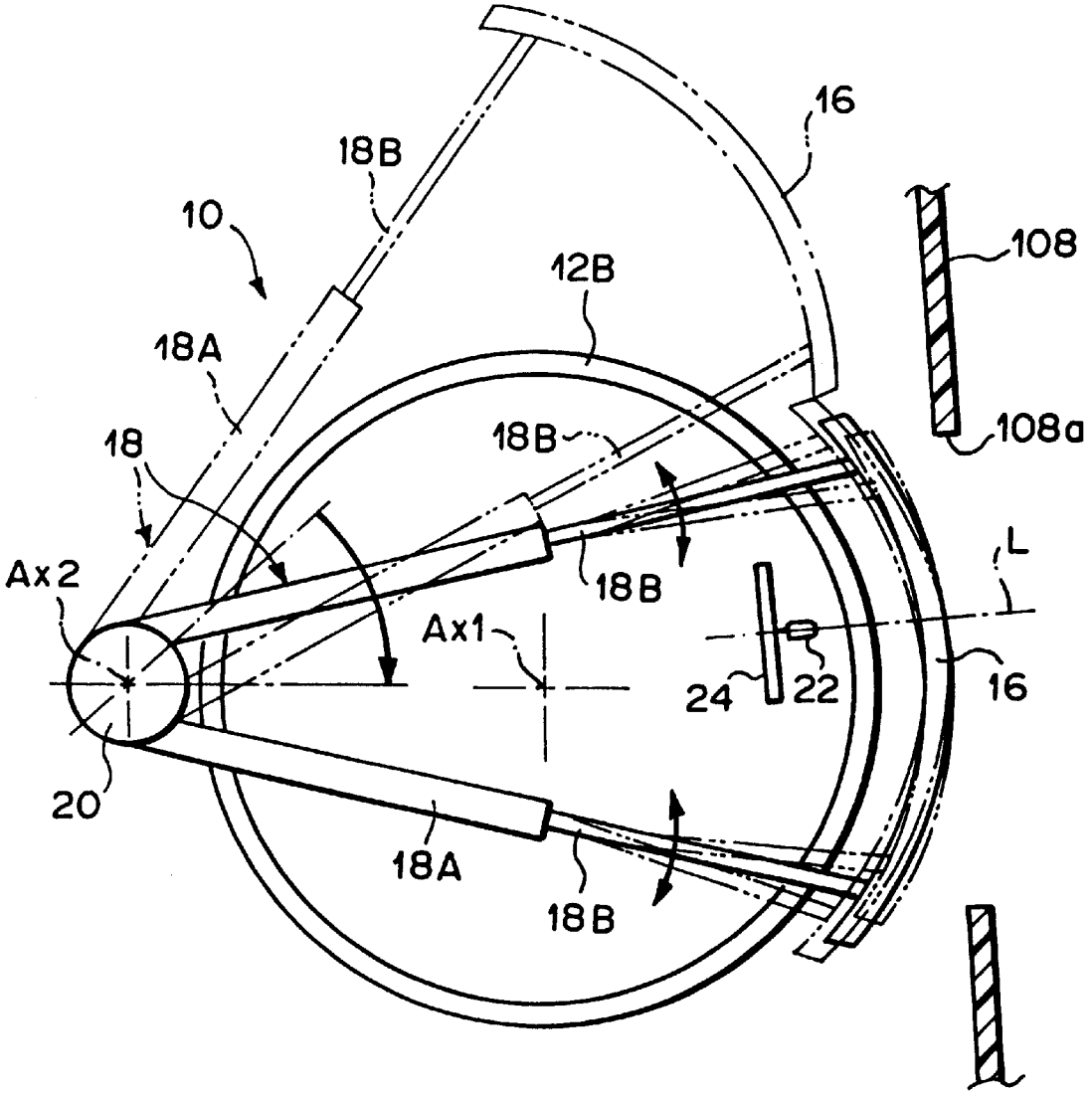
FIG. 3 is a side view showing a main part of the above-mentioned reel apparatus.

As shown in FIG. 3, the base end portion of each pivotal lever 18 is connected to a motor 20 which is secured to the reel supporting bracket 14 in the vicinity of the center reel 12B on its rear side. As the rotor 20 is driven, each of the pivotal levers 18 pivots about a pivotal axis Ax2 positioned in the vicinity of the center reel on its rear side, thereby moving the cover member 16, which is secured to the tip portion thereof, between the position of the display window (position indicated by solid lines) and the shelter position (position indicated by chain double-dashed line).

In each of the pivotal levers 18, its base end portion is constituted by a V-shaped resin member 18A, while its tip portion is made of a pair of upper and lower stainless steel members 18B. The resin member 18A has a rectangular cross section, whereas each stainless steel member 18B is formed like a plate. These members are integrally formed by insert molding. In each pivotal lever 18, with respect to the load about the pivotal axis Ax2, the resin member 18A functions as a rigid body, whereas the stainless steel member 18B functions as an elastic body. Consequently, when each pivotal lever 18 is pivoted about the pivotal axis Ax2 so as to move the cover member 16 from the shelter position 16 to the position of the display window 108*a* and is stopped at the latter position, the stainless steel member 18B is elastically deformed due to an inertial force, whereby the cover member 16 minutely vibrates as indicated by chain double-dashed lines. As this minute vibration gradually attenuates, the cover member 16 stops at the position indicated by solid lines.

Figure 4:
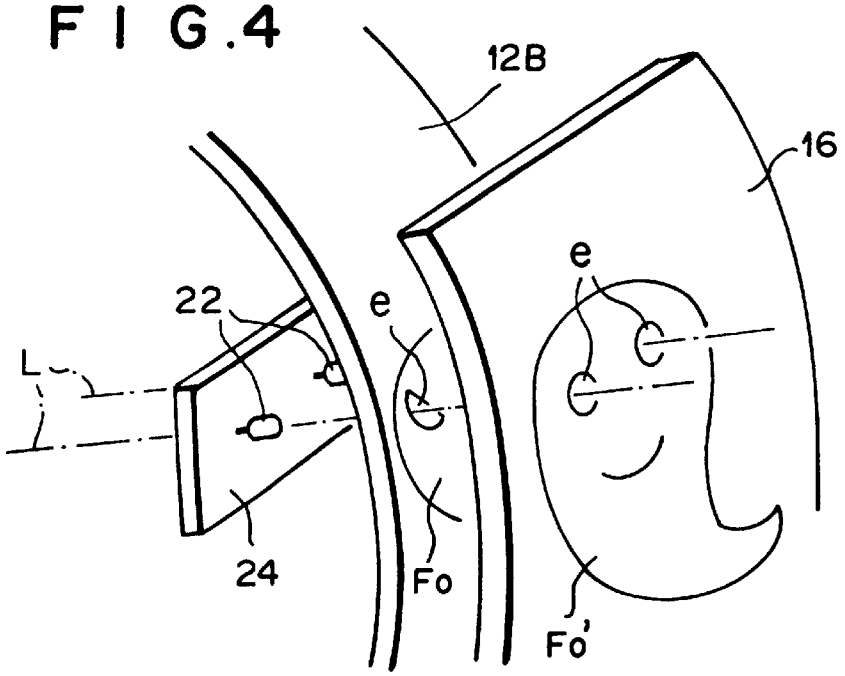
FIG. 4 is a perspective view showing a main part of FIG. 3.

In FIG. 3, in the vicinity of the peripheral surface of the center reel 12B within the space on the inner periphery side thereof, a pair of right and left LEDs 22 are disposed. As shown in FIG. 4, the pair of LEDs 22 are disposed, with the same lateral pitches as those of the pair of eyes e of the picture Fo and those of the pair of eyes e' of the picture Fo', so as to be respectively positioned on lines L connecting the pair of eyes e and their corresponding pair of the eyes e' when the pictures Fo and Fo' are stopped at the same display window 108*a*.

As explained in detail in the foregoing, in the reel apparatus 10 for a game machine in accordance with this embodiment, in front of the lastly stopping center reel 12B among the three reels 12A, 12B, and 12C, there is disposed the cover member 16, which is formed with the picture Fo' and movable between the position of the display window 108*a* and the shelter position thereabove. When the reel 12B is stopped such that its picture Fo is placed at the display window 108*a*, in the case where each of the other two reels 12A and 12C is stopped with the picture Fo placed at its corresponding display window 108*a* (i.e., in the case of a jackpot), the cover member 16 moves from its shelter position to the position of the display window 108*a*, and minutely vibrates at the position of the display window 108*a* before being stopped. Consequently, the picture Fo' formed in the cover member 16 appears in an unusual manner, so as to sufficiently enhance the player's impression when winning a jackpot, thus allowing enjoyability to improve.

Also, in this embodiment, the cover member 16 is supported by the tip portion of the pivotal lever 18 rotatably disposed about the pivotal axis Ax2, whereas the pivotal lever 18 is pivoted by the motor 20 connected to the base end portion of the pivotal lever 18 so that the cover member 16 can be placed at the position of the display window 108*a* and the shelter position. Since the tip portion of the pivotal lever 18 is constituted by the stainless steel member 18B, and the cover member 16 is caused to minutely vibrate as mentioned above due to the elastic deformation of the stainless steel member 18B, the above-mentioned effect can be realized by a simple configuration.

Further, in this embodiment, pairs of right and left eyes e and e' are respectively formed in the picture Fo of the reel 12B and the picture of Fo' of the cover member 16 each as a light-transmitting portion, whereas a pair of LEDs 22 are disposed within the space on the inner periphery side of the reel 12B. When the reel 12B is stopped such that the picture Fo is placed at the display window 108*a*, while the cover member 16 is stopped at the position of the display window 108*a*, each LED 22 and its corresponding eyes e and e' are positioned on the single line L, whereby light beams from the pair of LEDs 22 are transmitted through the pair of eyes e and the pair of eyes e' so as to advance ahead of the reel 12B upon winning a jackpot. As a result of this effect, the player's impression can be further enhanced.

In this embodiment, when the lastly stopping center reel 12B is stopped such that the picture Fo is placed at the display window 108*a*, the case where each of the two other reels 12A and 12C is stopped with the identical pictures Fo placed at the display window 108*a*, i.e., the case where all the three pictures are the identical pictures Fo, is defined as a jackpot, at which the effect of the cover member 16 is produced. Without being restricted thereto, however, when the lastly stopping center reel 12B is stopped, the effect of the cover member 16 may be produced also in the case where the other two reels 12A and 12C are stopped with specific pictures which yield a jackpot in combination with a picture with which the center reel 12B is supposed to stop.

In the following, a second embodiment of the present invention will be explained.

Figure 5:
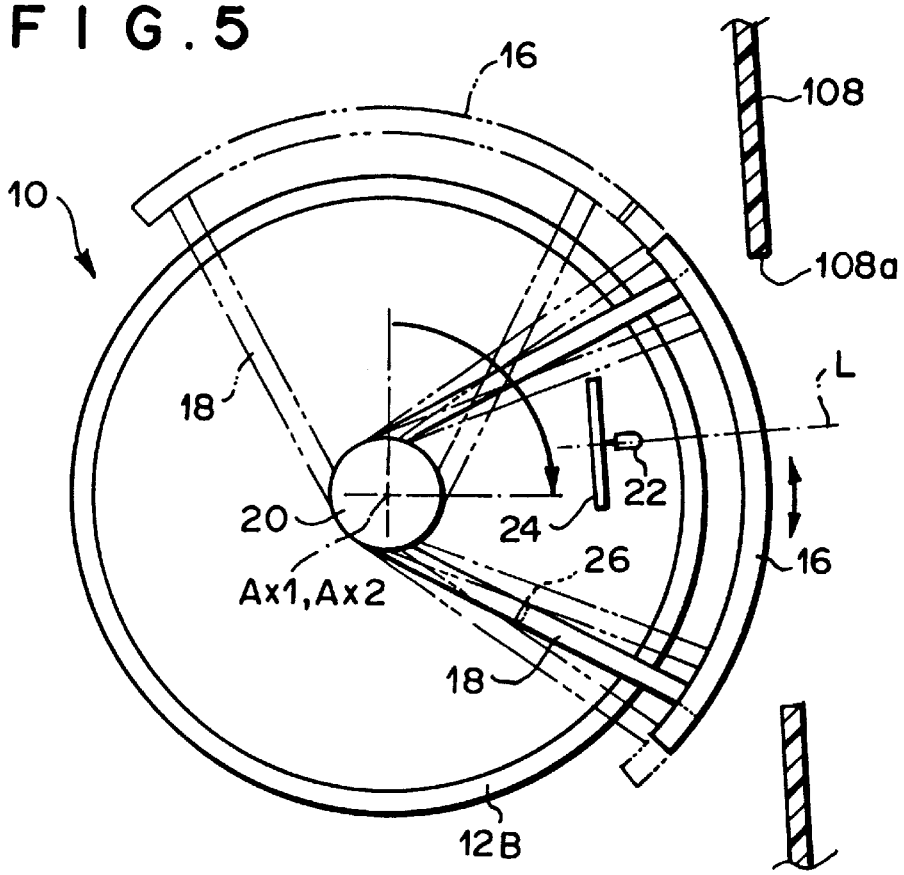
FIG. 5 is a side view showing a main part of a reel apparatus for a game machine in accordance with a second embodiment of the present invention.

FIG. 5 is a side view showing a main part of the reel apparatus for a game machine in accordance with this embodiment.

While the reel apparatus 10 of this embodiment is similar to that of the first embodiment in terms of the configurations of three reels 12A, 12B, and 12C and cover member 16, they differ from each other in the configuration of the pivotal lever 18 and the method of driving and controlling the motor 20.

Namely, while a pair of pivotal levers 18 are respectively disposed on both sides of the center reel 12B, each pivotal lever 18 is made of a rigid resin member, and its pivotal axis Ax2 is set on the same axis as the rotating axis Ax1 of the reels 12A, 12B, and 12C.

As in the case of the first embodiment, each pivotal lever 18 is driven by the motor 20 so as to pivot about the pivotal axis Ax2. Here, when the motor 20 drives and controls each pivotal lever 18 so as to move the cover member 16 from the shelter position indicated by chain double-dashed lines to the position of the display window 108*a*, the cover member 16 is stopped at the latter position after being minutely vibrated there for a predetermined period of time.

In order to enable such driving control, one pivotal lever 18 of the pair of the pivotal levers 18 is provided with a protrusion 26 for detecting a pivotal angle position. This protrusion 26 and a photosensor (not depicted) detect that each pivotal lever 18 reaches the position indicated by solid lines. Based on the resulting detection signal, when each pivotal lever 18 pivots from the shelter position to the position of the display window 108*a*, the motor 20 causes each pivotal lever 18 to pivot, as it is, to a position indicated by chain double-dashed lines (slightly below the position indicated by solid lines) and then, in the opposite direction, to a position indicated by chain double-dashed lines (slightly above the position indicated by solid lines). Then, after being reciprocated several times between the positions indicated by chain double-dashed lines, each pivotal lever 18 is stopped at the position indicated by solid lines.

Thus, also in this embodiment, the cover member 16 is stopped at the position indicated by solid line after being minutely vibrated. Accordingly, the picture Fo' formed in the cover member 16 appears in an unusual mode. As a result of this effect, the player's impression when winning a jackpot can be sufficiently enhanced, thereby allowing enjoyability to improve.

In particular, in this embodiment, since such an effect can be obtained by the driving control of the motor 20, each pivotal lever 18 can be constituted by a rigid body alone, whereby its configuration can be simplified.

The reel apparatus for a game machine in accordance with the present invention comprises a plurality of reels which rotate around a single axis, each having a plurality of pictures formed in series on a peripheral surface thereof along a circumferential direction thereof, the reels being rotated independently from each other and automatically stopped in sequence while each placing one of the plurality of pictures at a preset angle position. A cover member formed with a predetermined picture and movable between the preset angle position and a shelter position other than the preset angle position is disposed in front of the lastly stopping reel of the plurality of reels. When the lastly stopping reel is stopped so as to place a predetermined picture at the preset angle position, in the case where another reel is stopped so that a specific picture is placed at the preset angle position in combination with the predetermined picture, the cover member moves from the shelter position to the preset angle position and minutely vibrates at the preset angle position before being stopped. Accordingly, the predetermined picture formed in the cover member appears in an unusual mode, whereby the player's impression when winning a prize is fully enhanced, thus allowing enjoyability to improve.

What is claimed is:

1. A reel apparatus for a game machine, said reel apparatus comprising a plurality of reels which rotate around a single axis, each of said reels having a plurality of pictures formed in series on a peripheral surface thereof along a circumferential direction thereof, said reels being rotated independently from each other and automatically stopped in sequence while each placing one of said plurality of pictures at a preset angle position;

wherein a cover member formed with a predetermined picture and movable between said preset angle position and a shelter position other than said preset angle position is disposed in front of a lastly stopping reel of said plurality of reels; and wherein, when said lastly stopping reel is stopped so as to place a predetermined picture at said preset angle position, in a case where another of said reels is stopped so that a specific picture is placed at said preset angle position in combination with said predetermined picture, said cover member moves from said shelter position to said preset angle position and minutely vibrates at said preset angle position before being stopped.

2. The reel apparatus according to claim 1, wherein said cover member is supported by a pivotal lever which is pivotally disposed around a predetermined pivotal axis; and a pivotal lever driving means for pivoting said pivotal lever such that said cover member can be placed at said preset angle position and said shelter position.

3. The reel apparatus according to claim 2, wherein a part of said pivotal lever is constituted by an elastic member which causes said cover member to minutely vibrate.

4. The reel apparatus according to claim 2, wherein said pivotal lever driving means drives and controls said pivotal lever so as to cause said cover member to minutely vibrate.

5. The reel apparatus according to claim 1, further comprising a light-emitting member within a space on an inner periphery side of said lastly stopping reel;

wherein said predetermined picture of said lastly stopping reel and said predetermined picture of said cover member are respectively formed with light-transmitting portions; and wherein, when said lastly stopping reel is stopped so as to place said predetermined picture at said preset angle position while said cover member is stopped at said preset angle position, said light-emitting member and both of said light-transmitting portions are positioned on a single line.

* * * * *